US005433337A

United States Patent [19]

Willbrandt

[11] Patent Number: 5,433,337

[45] **Date of Patent: * Jul. 18, 1995**

[54] LARGE DRINK CONTAINER TO FIT VEHICLE CUP HOLDERS

[75] Inventor: George A. Willbrandt, Fairfax, Va.

[73] Assignee: Sterling Products, Inc., Winchester, Va.

[ * ] Notice: The portion of the term of this patent subsequent to Jun. 27, 2012 has been disclaimed.

[21] Appl. No.: 186,419

[22] Filed: Jan. 28, 1994

[51] Int. Cl.[6] ..... B65D 21/02

[52] U.S. Cl. ..... 220/669; 229/400

[58] Field of Search ..... 220/673, 675, 669; 229/1.5 B

[56] References Cited

U.S. PATENT DOCUMENTS

| | | | |
|---|---|---|---|
| D. 47,527 | 6/1915 | Sanford . | |
| D. 81,984 | 9/1930 | Kirkpatrick . | |
| D. 110,902 | 8/1938 | Loesch . | |
| D. 169,370 | 4/1953 | Greenspan . | |
| D. 198,139 | 5/1964 | Edwards | D44/9 |
| D. 204,783 | 5/1966 | Johnson . | |
| D. 217,781 | 6/1970 | Stone | D36/8 |
| D. 239,151 | 3/1976 | Lundin | D7/6 |
| D. 247,601 | 3/1978 | Schreckengost . | |
| D. 248,916 | 8/1978 | Reynolds et al. . | |
| D. 258,483 | 3/1981 | Weinstein . | |
| D. 274,695 | 7/1984 | Kennedy | D9/352 |
| D. 285,032 | 8/1986 | Alonzo | D7/6 |
| D. 285,999 | 10/1986 | Ludwick et al. | D7/6 |
| D. 331,684 | 12/1992 | Trombley . | |
| D. 346,932 | 5/1994 | Cautereels et al. . | |
| D. 346,933 | 5/1994 | Denny et al. . | |
| 604,514 | 5/1898 | Belden . | |
| 2,963,256 | 12/1960 | Borah | 248/346 |
| 3,079,027 | 2/1963 | Edwards | 220/9 |
| 3,128,029 | 4/1964 | Price et al. | 229/1.5 |
| 3,342,370 | 9/1967 | Johnson | 229/1.5 B X |
| 3,484,018 | 12/1969 | Davis | 229/1.5 B X |
| 3,934,725 | 1/1976 | Edwards | 229/1.5 B X |
| 4,039,435 | 8/1977 | Narva | 206/217 |
| 4,052,037 | 10/1977 | Mair et al. | 229/1.5 B X |
| 4,061,782 | 12/1977 | Baxter | 426/86 |
| 4,193,494 | 3/1980 | Green | 229/1.5 B X |
| 4,231,476 | 11/1980 | Compton et al. | 229/1.5 B X |
| 4,551,366 | 11/1985 | Maruhashi et al. | 428/35 |
| 4,618,066 | 10/1986 | Vail . | |
| 4,832,202 | 5/1989 | Newman et al. | 229/1.5 B X |
| 4,854,468 | 8/1989 | Dahlquist et al. | 220/85 H |
| 5,088,673 | 2/1992 | Chandler | 248/311.2 |
| 5,305,911 | 4/1994 | Aylward | 220/675 |

OTHER PUBLICATIONS

Orphan Annie Cup with Lid (lower right) Modern Plastics, Feb. 1946, p 96.

Decorated Barware (bottom left), Home Furnishings Daily, p. 11, Dec. 19, 1960.

*Primary Examiner*—Steven M. Pollard

*Attorney, Agent, or Firm*—Willian Brinks Hofer Gilson & Lione

[57] ABSTRACT

A container, such as a cup, adapted to fit securely in most vehicle container receptacles, with a lower body portion of a diameter to fit standard vehicle container receptacles. The lower body portion is comprised of fluted sides that provide strength and support to the lower body portion and facilitate material flow in manufacture so that the container can be made of an ultra thin material and yet hold a large volume of liquid.

38 Claims, 4 Drawing Sheets

LARGE DRINK CONTAINER TO FIT VEHICLE CUP HOLDERS

BACKGROUND OF THE INVENTION

1. Field of the Invention

The claimed invention relates to an improved container, such as a drinking cup, particularly used in conjunction with vehicle container receptacles (or holders), such as those found in cars, boats, and trucks. More particularly, the claimed invention relates to an improved container which can hold large quantities of beverage yet fit securely in the standard vehicle container receptacle without spilling.

2. Description of Related Art

Most cars contain a receptacle for holding containers, such as cups and cans, so that the beverage will not spill when the vehicle is moving. These standard vehicle container receptacles are generally sized to receive an aluminum can typically used with soft drinks having a cylindrical shape and a diameter of about 2½ inches. Oftentimes larger beverage containers, e.g., having a capacity of over 21 ounces, have a diameter of greater than 2½ inches and do not fit into the vehicle container receptacle. These larger beverage containers must either be held by the driver or passenger, or placed elsewhere in the car where they are likely to spill their contents.

To cope with this problem, most cups, especially those used in drive-thru food services, are limited to a size that will fit a standard vehicle container receptacle. However, traditionally styled cups which fit standard vehicle container receptacles are limited to a volume of about 21 ounces. Specifically, when a container larger than 21 ounces is designed to fit the standard vehicle container receptacle the container is top heavy when filled with liquid. It has been recognized in the art that, to offset this problem, it would be desirable to design a container which would fit snugly into a standard vehicle container receptacle and would not tip or spill its contents during movements of the vehicle, even in a sudden turn or stop.

One method which allows larger containers to fit in standard vehicle container receptacles involves the use of an adapter. The adapter modifies the standard vehicle container receptacle to a size such that larger containers can be accommodated by the standard vehicle container receptacle. Dahlquist II et al., U.S. Pat. No. 4,854,468, and Chandler, U.S. Pat. No. 5,088,673, disclose container adapter devices designed so that a standard vehicle container receptacle can accommodate containers that are too large to fit in the standard vehicle container receptacle.

Of late, cups designed with a base proportioned to fit the standard vehicle container receptacle having a main body portion of a size larger than the base have attempted to overcome the problems of the limited container volume and top heaviness. However, these designs still cannot hold a very large volume of beverage, and are made of heavy materials, such as glass, to reduce top heaviness. The GOJO TM cup manufactured by Highwave, Inc. is an example of this type of design.

While the prior art discussed above provides important advantages, the prior art does not provide a container which can hold a large volume of liquid and yet fit the standard size vehicle container receptacle without being top heavy.

SUMMARY OF THE INVENTION

According to the invention, a beverage container (also referred to herein as a "container") is provided which is sized to fit securely in a standard vehicle container receptacle and still accommodate up to 46 ounces, and preferably about 32 to about 46 ounces, of a beverage. The container comprises a base, a lower body portion of a size to fit in the standard vehicle container receptacle, the lower body portion extending substantially upward from the base, and an upper body portion of a size such that the container holds the desired amount of a beverage. A shoulder extends radially outward from the lower body portion and the upper body portion extends substantially upward from the shoulder. The upper body portion is opened at the top to create an opening. The shoulder aids the container in securely nesting in the vehicle container receptacle.

In order to strengthen the sidewalls of the lower body portion and to facilitate material flow in manufacture of the upper body portion, the lower body portion of the container is formed of a series of fluted sides that provide support to the lower body portion. Further, an accompanying lid provides additional strength to the upper body portion of the container. The fluted sides increase in thickness as they extend upward from the base to the shoulder to improve material flow to the upper body portion during manufacturing, increase manufacturing speeds for cost reductions and increase production outputs. Since the material flow is improved, the container can be made from relatively thin injection molded plastic, paper or other suitable combination of composite materials known to those skilled in the art.

Another embodiment of the invention is directed to a method of increasing strength of a container, comprising a base, a lower body portion extending substantially upward from the base, a shoulder attached to and extending radially outward from the lower body portion, and an upper body portion extending upwardly from the lower body portion. The method comprises including in the lower body portion a plurality of vertically fluted sides which strengthen the entire container, and an accompanying lid which further strengthens the upper body portion.

Yet another embodiment of the invention is directed to a method of injection molding a container from a molten plastic material. Such a method comprises the following steps: the molten plastic material is injected into a mold including a first section having a first cavity of a progressively increasing dimension in the direction of flow of the molten plastic material; and subsequently the molten plastic material is directed to flow into a second section having a second cavity of a substantially constant dimension, the dimension of the second cavity being less than the largest dimension of the first cavity.

As pointed out in greater detail below, the container of this invention provides important advantages. The reduced thickness of the upper body portion allows the rim of the container to be reduced in size, and thus provides more compact nesting of the container. Additionally, the container fits standard food service dispensers, seven inch fill height restrictions, paper cup disposable lids and food service straws so that the container can be incorporated for use with existing beverage dispensing machines, such as those used in fast food restaurants.

The invention itself, together with further objects and attendant advantages, will best be understood by reference to the following description, taken in conjunction with the accompanying drawings.

DETAILED DESCRIPTION OF THE PREFERRED EMBODIMENTS

The preferred embodiments of the invention will be described below in conjunction with a cup for a beverage.

Figure 1:
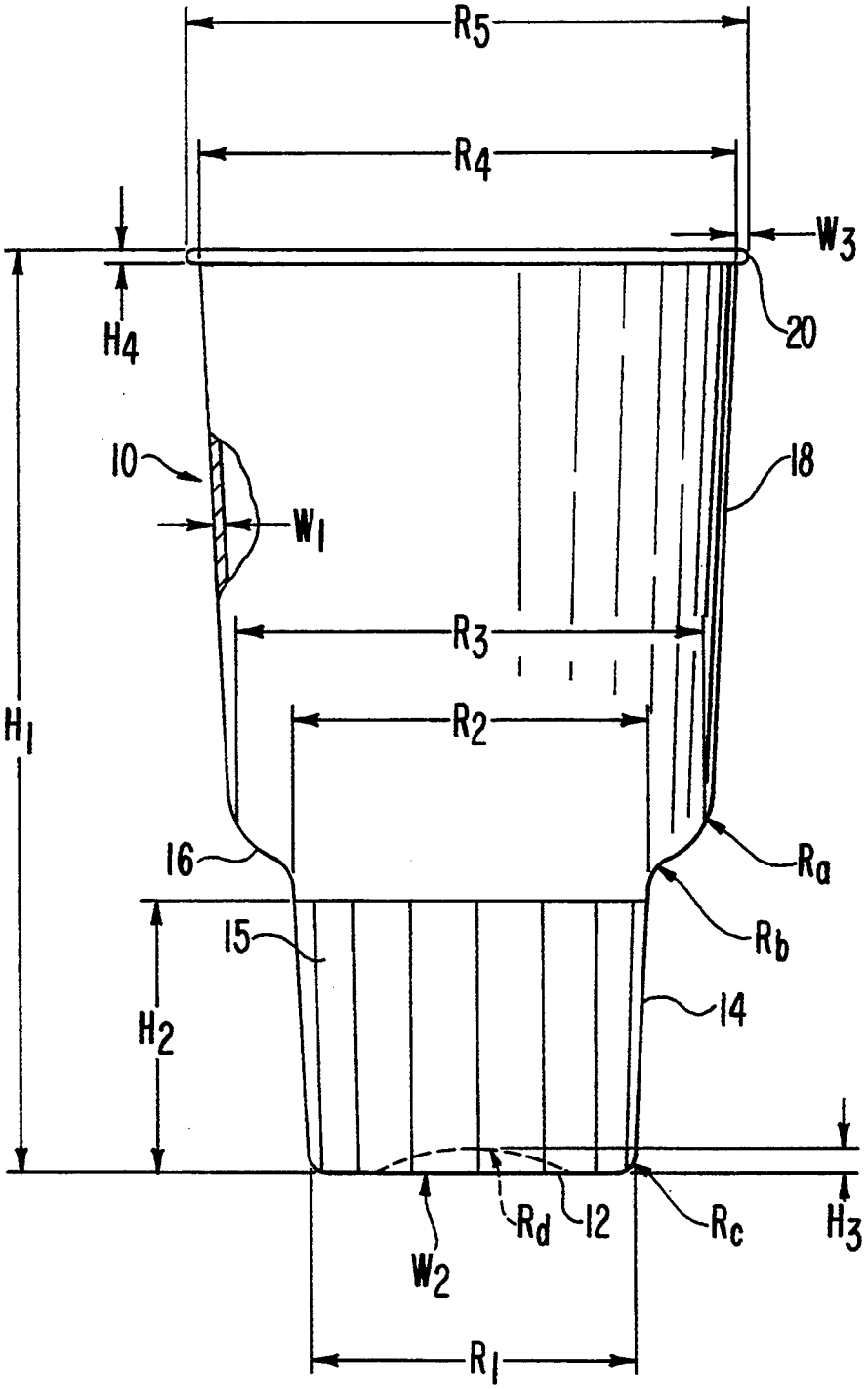
FIG. 1 is a side view of an embodiment of the container of this invention.
Figure 2:
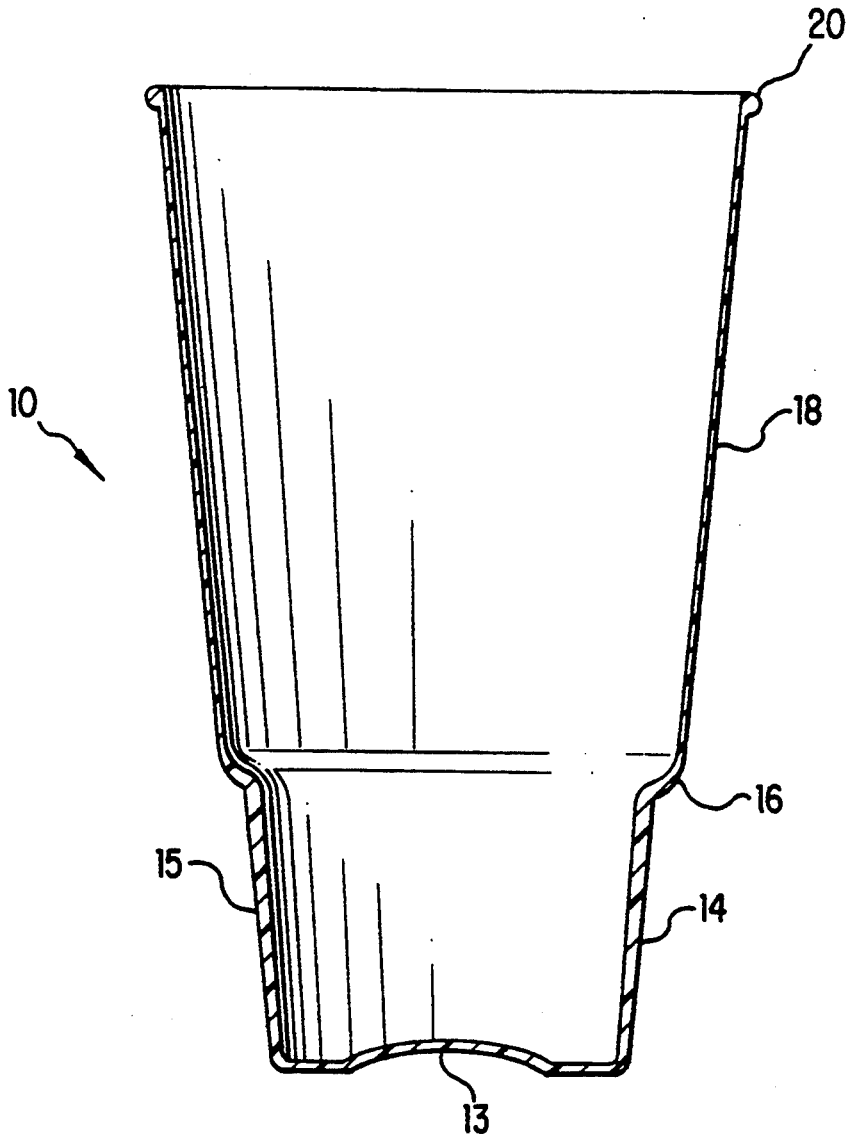
FIG. 2 is a sectional view of the embodiment of FIG. 1 of the container of this invention.

Turning now to the drawings, FIG. 1 shows the preferred embodiment of a cup designated generally by the numeral 10, and FIG. 2 shows a sectional view of the cup 10. The cup 10 includes a substantially circular base 12 attached to a lower body portion 14. The base 12 contains a meniscus portion 13 having a preferred radius $R_d$ of about 0.980 inch and preferred height $H_3$ of about 0.1800 inch. The thickness $W_z$ of the base 12 is about 0.020 to about 0.040 inches. The preferred thickness $W_2$ of the base 12 is about 0.030 inch. The lower body portion 14 increases in diameter from the base 12 extending upward toward a shoulder 16. The typical diameter for a vehicle container receptacle is about 2½ inches. Thus, the base 12 and the lower body portion 14 are of a diameter to provide a secure fit for the cup in the vehicle container receptacle. The lower body portion 14 may have a diameter $R_1$ of about 2¼ inches to about 2⅝ inches at the base 12 and a diameter $R_2$ of about 2½ inches to about 2⅞ inches at the top thereof. Preferably, the diameter $R_1$ of the lower body portion 14 ranges in size from about 2½ inches to about 2⅝ inches, with the most preferred size of $R_1$ being about 2½ inches at the base, and the diameter $R_2$ of the lower body portion 14 is about 2½ inches to about 3.0 inches, with the most preferred size of $R_2$ being about 2¾ inches where the lower body portion 14 meets the shoulder 16. Where the lower body portion 14 meets the base 12, the corners are tapered and have a radius $R_c$ of about 0.0930 inch. The overall diameter of the lower body portion 14 is such that the lower body portion 14 is of a lesser diameter than the upper body portion 18.

The lower body portion 14 is comprised of a plurality of vertically fluted sides 15 which strengthen the lower body portion 14. As shown in FIG. 2, the fluted sides increase in thickness moving upward from the base 12 to a shoulder 16. The fluted sides 15 have a thickness of about 0.008 inch to about 0.025 inch, preferably about 0.010 inch to about 0.022 inch, at the base 12, and about 0.040 inch to about 0.055 inch, preferably about 0.042 inch to about 0.048 inch, where the lower body portion 14 meets the shoulder 16. In the preferred embodiment, the thickness of the fluted sides 15 increases from about 0.020 inch at the base 12 to about 0.044 inch where the lower body portion 14 meets the shoulder 16. The plurality of the fluted sides 15 provides lateral support to the lower body portion 14 of the cup 10 and facilitates material flow in manufacture of the upper body portion 18 so that the cup 10 can be made of a relatively thin material, such as paper, plastic or similar materials and still hold approximately 32 to 48 ounces of beverage. The number of fluted sides is at least eight, preferably at least twelve, and it may be at least sixteen. Alternatively, the number of fluted sides is eight to twenty, preferably ten to twenty, and most preferably twelve to eighteen. In one preferred embodiment, the cup has sixteen fluted sides.

Figure 3:
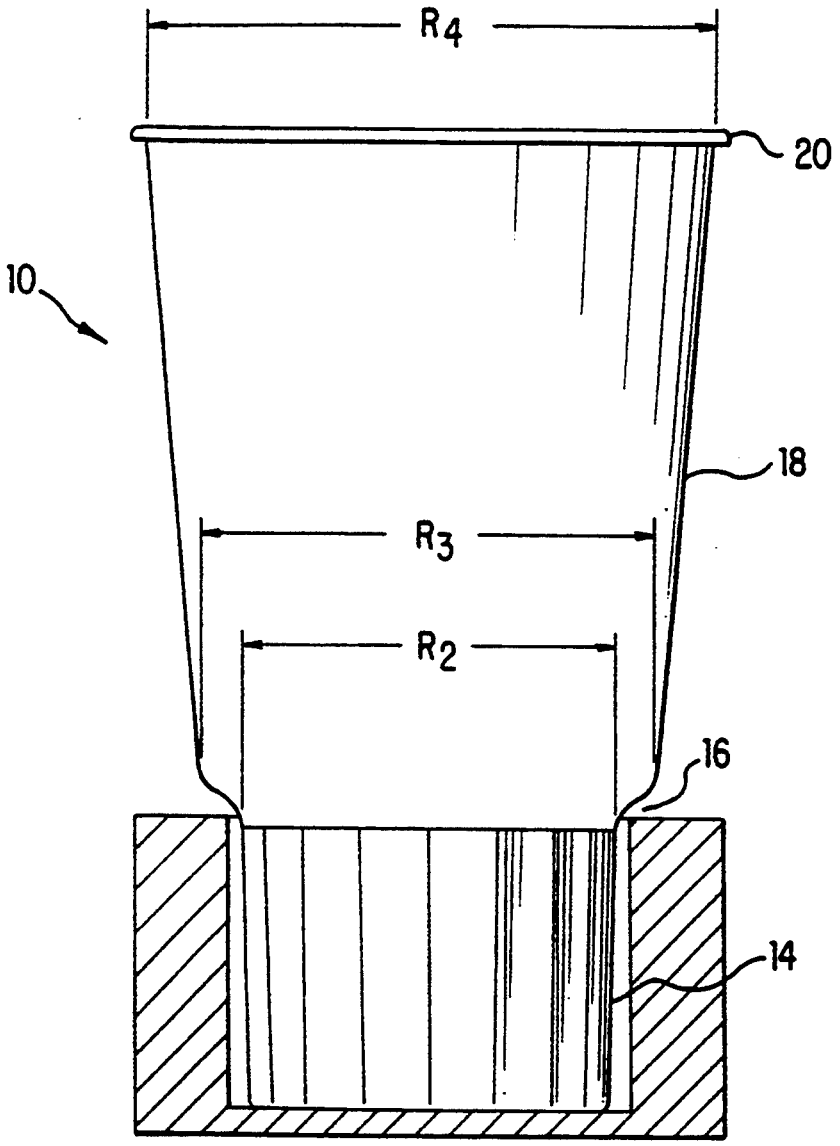
FIG. 3 is a side view of the container of this invention seated in a vehicle container receptacle.

As shown in FIGS. 1 and 3, the lower body portion 14 is of an axial length $H_2$ such that it can maintain a restrained configuration and not inadvertently dislodge from the standard vehicle container receptacle. The lower body portion 14 may have an axial length $H_2$ of about 1¾ inches to about 2½ inches, preferably about 2 inches to about 2⅛ inches. In one preferred embodiment, the lower body portion 14 is about 2 inches in axial length and the sides of the lower body portion 14 abut against the support structure of the vehicle cup receptacle and prevent the lower body portion 14 from dislodging inadvertently from the vehicle cup receptacle.

The shoulder 16 extends radially outward from the lower body portion 14 and forms a transitional surface between the lower and upper body portions 14 and 18. At the point where the shoulder 16 meets the lower body portion 14, the shoulder 12 has a radius $R_b$ of about 3/16 inch extending to a radius $R_a$ of about 5/16 inch where the shoulder 16 attaches to the upper body portion 18. As shown in FIG. 3, the shoulder 16 is designed to provide a stabilizing area between the lower and upper body portions 14 and 18 that rests against the vehicle cup receptacle. The height of the shoulder 16 may vary from about ⅛ inch to about 1 inch, preferably from about ⅛ inch to about ¾ inch. In one preferred embodiment, the shoulder 16 is about ¼ inch in height.

Returning to FIG. 1, extending upward from the shoulder 16, the upper body portion 18 has a smooth wall surface and increases in diameter as it extends upward toward a rim 20. The upper body portion 18 has a substantially constant thickness $W_1$ of about 0.020 to about 0.040 inches. In one preferred embodiment, the thickness $W_1$ is 0.030 inch. The upper body portion 18 has a lower diameter $R_3$ (at the shoulder 16) of about 2.750 inches to about 3.500 inches, preferably about 2.875 inches to about 3.450 inches, and most preferably about 2.875 inches to about 3.420 inches. In one preferred embodiment, the upper body portion has a lower diameter $R_3$ of about 3.225 inches. The upper body portion 18 has an upper diameter $R_4$ (at the point where it forms an opening) of about 3.800 to about 4.650 inches, preferably about 3.850 to about 4.100 inches, and most preferably about 3.900 to about 4.100 inches. In one preferred embodiment, the upper body portion 18 has an upper diameter $R_4$ of about 3.900 inches.

The axial length of the upper body portion 18 may vary from about 4.500 inches to about 5.250 inches, preferably from about 4.750 inches to about 5.125 inches. In one preferred embodiment, the upper body portion 18 has an axial length of about 4.9375 inches so that the cup can hold about 32 ounces of a beverage. In addition, an axial length of 4.9375 inches provides a large printing area on the upper body portion 18 so that logos printed on the cup 10 are completely visible even when the cup 10 is resting in a vehicle cup receptacle. In one preferred embodiment, the total axial length $H_1$ of the cup 10 is about 6.9375 inches.

Figure 4:
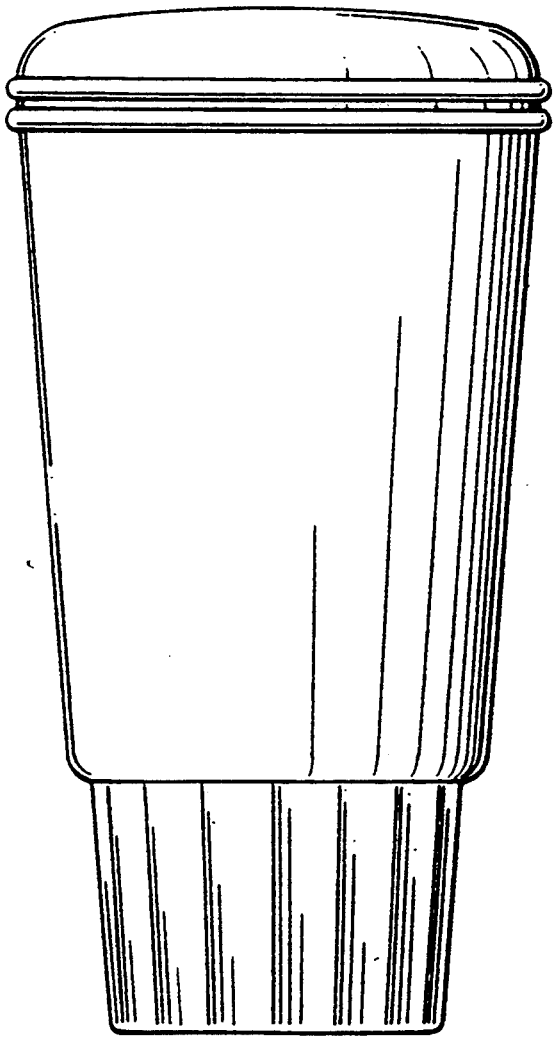
FIG. 4 is a side view of an embodiment of the container with lid.

At its upper diameter, the upper body portion 18 is surrounded by a rim 20. The rim 20 is provided so that a molded lid as shown in FIG. 4, preferably semi-circular in shape, may fit securely on the cup 10. The molded lid, when inserted on top of the cup 10 strengthens it and makes the cup 10 rigid, steady, and spillproof. However, the cup 10 is also functional without the molded lid. The cup 10 will not collapse if it is filled with liquid, and the molded lid is not attached to the opening of the cup 10. The molded lid can be made from the same type of material as the cup 10 or from any other suitable material.

Because of the increased strength of the upper body portion 18 when secured with the molded lid, the cup 10 does not require a stacking shoulder found in conventional plastic and paper cups. Thus, the rim 20 can be reduced from the standard height of about ¾ inch to a height $H_4$ ranging from about 1/16 inch to about ½ inch, and preferably the height of the rim is about 1/10 inch to about ¼ inch. In one preferred embodiment, the rim 20 is about 1/10 inch in height. The narrower rim 20 allows for better nesting of the cup 10 and thus the number of cups that can be packed in a case is increased.

The width (thickness), $W_3$, of the rim 20 is about 0.15 inch to about 0.30 inch, preferably about 0.15 inch to about 0.25 inch, and most preferably about 0.18 inch to about 0.25 inch. In the preferred embodiment, the width of the rim is about 0.22 inch. The diameter $R_5$ of the cup is about 4.000 to about 4.225 inches. In one preferred embodiment, the diameter $R_5$ of the cup 10 is about 4.120 inches.

The cup 10 can be made by any suitable method known to those skilled in the art, such as injection molding, blow molding, vacuum forming, stretch molding, or thermal molding. The preferred method uses injection molding which is well known to those skilled in the art.

In the preferred embodiment of manufacturing the cup by injection molding, the provision of fluted sides, having progressively increasing size in an upward direction provides an important manufacturing advantage. To produce such fluted sides, the mold used for manufacturing the cup must have a shape such that the dimension of the cavity of the section of the mold which will form the fluted sides increases progressively in the direction of flow of molten, injection molded plastic material. That section is located upstream of the section of the mold which will form the upper body portion 18 of the cup. In a preferred embodiment, the injection rate for injection molding must be at least about 0.2 to 0.3 seconds.

The cavity of the section of the mold which will form the upper body portion 18 has a substantially constant, relatively thin dimension (so that it would form the upper body portion having a substantially constant thickness $W_1$). The use of such a mold produces the cup of this invention having the upper body portion of relatively thin, relatively constant dimensions which were difficult, if not impossible, to obtain heretofore. For example, a conventional 32 ounce cup weighs about 42 grams, but the cup 10 of this invention weighs about 32 grams to about 35 grams.

Without wishing to be bound by any theory of operability, it is believed that the section of the mold with a cavity having the progressively increasing dimension provides relief from pressure of injection molding, thereby enabling the injection molding apparatus to inject the molten material into even the smallest crevices of the relatively thin section of the mold which will form the upper body portion of the cup.

The method used in this preferred embodiment to manufacture the cup 10 from a molten plastic material comprises the following steps.

The molten plastic material is injected into a mold comprising a first section having a cavity of progressively increasing dimension in direction of flow of the molten plastic material. The molten plastic is then directed into a second section containing a second cavity of a substantially constant dimension. The dimension of the second cavity is less than the largest dimension of the first cavity.

The cup 10 can be made of any suitable material, such as high density polyethylene, polypropylene, styrene, or other suitable plastic materials as well as paper or other suitable combination of composite materials known to those skilled in the art. In the preferred embodiment, the cup 10 is made of high density polyethylene or polypropylene. In the most preferred embodiment, the cup 10 is made of high density polyethylene (HDPE) made by Dow Chemical Company, designated IP-60, having a specific gravity of 0.91 to 0.97, and believed to have a density of 0.955 g/cc. Because of the unique construction of the cup 10, the amount of material needed for its production is about 20% less than would have been necessary using a conventional design and construction method.

Variations on the embodiments described above are possible. For example, the cup 10 is described herein as being circular in cross section because standard vehicle container receptacles for soft drink cans and similar articles are circular in cross section. However, equivalent structures of differing cross sections, e.g., square or triangular cross sections, could be made following the principles of this invention. Where a square or other shaped cross section is used, it is preferred that the diagonal of such a cross section corresponds substantially to the diameter of the circular cross section.

The embodiments described above provide a number of significant advantages. The unique shape of the cup 10 enables the cup 10 to fit most vehicle container receptacles, while still conforming its size to the standards of existing food service cup dispensers, fill height restrictions, lids and straws. Additionally, the fluted sides 15 of the lower body portion 14 facilitate material flow in manufacture of the upper body portion 18 so that the cup 10 can be produced from relatively thin materials, such as paper and plastic, and still hold a large volume of beverage without being top heavy. Finally, the increased strength of the upper body portion 18, when the cup is secured with the molded lid, means that the rim 20 may be reduced in size, thus allowing for better nesting of stacked cups and reduction in case cup size.

Of course, it should be understood that a wide range of changes and modifications can be made to the preferred embodiments described above. It is therefore intended that the foregoing detailed description be regarded as illustrative rather than limiting and that it be understood that it is the following claims, including all equivalents, which are intended to define the scope of this invention.

I claim:

1. A container for a vehicle cup holder comprising:

a base;

a lower body portion extending substantially upward from said base, said lower body portion comprising a plurality of fluted sides;

a shoulder extending radially outward from said lower body portion;

each of said fluted sides comprising a substantially one-dimensional surface, said fluted sides increasing in thickness in an upward direction from about 0.008–about 0.025 inch at said base to about 0.040 inch–about 0.055 inch at a point where said lower body portion meets said shoulder, said lower body portion having a length of about $1\frac{7}{8}$ to about $2\frac{1}{2}$ inches; and an upper body portion extending substantially upward from said shoulder to create an opening, the upper body portion having a substantially constant thickness of about 0.020 to about 0.040 inches, said upper body portion increasing in diameter as it extends upward, said upper body portion having a length of about 4.500 to about 5.250 inches, said upper body portion having an overall greater diameter than said lower body portion.

2. A container according to claim 1, wherein said lower body portion comprises at least eight fluted sides.

3. A container according to claim 1, wherein said lower body portion comprises at least twelve fluted sides.

4. A container according to claim 1, wherein said lower body portion comprises at least sixteen fluted sides.

5. A container according to claim 1, wherein said lower body portion comprises sixteen fluted sides.

6. A container according to claim 1, wherein each of said fluted sides increases in thickness from about 0.008 inch at said base to about 0.055 inch at said shoulder.

7. A container according to claim 1, wherein each of said fluted sides increases in thickness from about 0.020 inch at said base to about 0.044 inch at said shoulder.

8. A container according to claim 1, wherein said lower body portion is about two inches in length.

9. A container according to claim 1, wherein diameter of said lower body portion increases from about $2\frac{1}{2}$ inches at said base to about $2\frac{7}{8}$ inches at said shoulder.

10. A container according to claim 1, wherein diameter of said lower body portion increases from about $2\frac{1}{2}$ inches at said base to about $2\frac{3}{4}$ inches at said shoulder.

11. A container according claim 1, wherein said upper body portion is about 4.9375 inches in length.

12. A container according claim 1, wherein diameter of said upper body portion increases from about 2.750 inches at said shoulder to about 4.650 inches at said opening.

13. A container according claim 1, wherein diameter of said upper body portion increases from about 2.875 inches at said shoulder to about 4.100 inches at said opening.

14. A container according to claim 1, wherein said opening comprises a rim measuring about 1/16 inch to about $\frac{1}{2}$ inch in height.

15. A container according to claim 1, wherein said opening comprises a rim measuring about 1/10 inch in height.

16. A container of claim 1, wherein said lower body portion has a length of about 2 to about $2\frac{1}{8}$ inches.

17. A container of claim 1, wherein said upper body portion has a length of about 4.750 to about 5.125 inches.

18. A container of claim 1, wherein said fluted sides have a thickness of about 0.010 to about 0.022 inch at said base.

19. A container of claim 1, wherein said fluted sides have a thickness about 0.042 to about 0.048 inch at a point where said lower body portion meets said shoulder.

20. A container of claim 1, wherein diameter of said lower body portion is about $2\frac{1}{4}$ to about $2\frac{5}{8}$ inches at said base.

21. A container of claim 1, wherein diameter of said lower body portion is about $2\frac{1}{2}$ to about $2\frac{5}{8}$ inches at said base.

22. A container of claim 1, wherein diameter of said lower body portion is about $2\frac{1}{2}$ to about $2\frac{7}{8}$ inches at said shoulder.

23. A container of claim 1, wherein diameter of said lower body portion is about $2\frac{1}{2}$ to about 3.0 inches at said shoulder.

24. A method of increasing strength of a container, comprising:

including in said container a base, a lower body portion extending substantially upward from said base and having a length of about $1\frac{7}{8}$ to about $2\frac{1}{2}$ inches;

a shoulder attached to and extending radially outward from the lower body portion;

an upper body portion extending upwardly from the lower body portion, said upper body portion having a length of about 4.500 to about 5.250 inches, said upper body portion having an overall greater diameter than said lower body portion, said upper body portion increasing in diameter as it extends upwards; and further including in said lower body portion a plurality of vertically fluted sides, each of said fluted sides comprising a substantially one-dimensional surface, and said fluted sides increasing in thickness in an upward direction from about 0.008—about 0.025 inch at said base to about 0.040 inch—about 0.055 inch at a point where said lower body portion meets said shoulder, said lower body portion having a length of about $1\frac{7}{8}$ to about $2\frac{1}{2}$ inches, the upper body portion having a substantially constant thickness of about 0.020 to about 0.040 inches.

25. A method according to claim 24, wherein each of said fluted sides increases in thickness from about 0.008 inch at said base to about 0.055 inch at said shoulder.

26. A method according to claim 24, wherein each of said fluted sides increases in thickness from about 0.020 inch at said base to about 0.044 inch at said shoulder.

27. A method of claim 24, wherein diameter of said lower body portion increases from about $2\frac{1}{2}$ inches at said base to about $2\frac{7}{8}$ inches at said shoulder.

28. A method according to claim 24, wherein said lower body portion is about two inches in length.

29. A method according claim 24, wherein diameter of said upper body portion increases from about 2.750 inches at said shoulder to about 4.650 inches at said opening.

30. A method according to claim 24, wherein said upper body portion is about 4.9375 inches in length.

31. A method of claim 24, wherein said lower body portion has a length of about 2 to about $2\frac{1}{8}$ inches.

32. A method of claim 24, wherein said upper body portion has a length of about 4.750 to about 5.125 inches.

33. A method of claim.21, wherein said-fluted sides have a thickness of about 0.010 to about 0.022 inch at said base.

34. A method of claim 24, wherein said fluted sides have a thickness about 0.042 to about 0.048 inch at a point where said lower body portion meets said shoulder.

35. A method of claim 24, wherein diameter of said lower body portion is about $2\frac{1}{4}$ to about $2\frac{5}{8}$ inches at said base.

36. A method of claim 24, wherein diameter of said lower body portion is about $2\frac{1}{2}$ to about $2\frac{5}{8}$ inches at said base.

37. A method of claim 24, wherein diameter of said lower body portion is about $2\frac{1}{2}$ to about $2\frac{7}{8}$ inches at said shoulder.

38. A method of claim 24, wherein diameter of said lower body portion is about $2\frac{1}{2}$ to about $2\frac{5}{8}$ inches at said shoulder.

* * * * *

UNITED STATES PATENT AND TRADEMARK OFFICE

CERTIFICATE OF CORRECTION

PATENT NO. : 5,433,337

DATED : July 18, 1995

INVENTOR(S) : George A. Willbrant

It is certified that error appears in the above-indentified patent and that said Letters Patent is hereby corrected as shown below:

Col. 7, Line 2, change "one-dimensional" to —planar—.

Col. 8, line 31, change "one-dimensional" to —planar—.

Signed and Sealed this

Fourteenth Day of May, 1996

*Attest:*

*Attesting Officer*

BRUCE LEHMAN

*Commissioner of Patents and Trademarks*